US006085481A

United States Patent [19]

Lee

[11] Patent Number: 6,085,481

[45] Date of Patent: Jul. 11, 2000

[54] GRILLE FOR A DOOR OR WINDOW

[76] Inventor: Ming-Kun Lee, 2/F., No. 13, Hsing-Nan St., Nan-Kang Dist., Taipei City, Taiwan

[21] Appl. No.: 09/165,497

[22] Filed: Oct. 2, 1998

[51] Int. Cl.[7] ..... E04C 2/54

[52] U.S. Cl. ..... 52/656.8; 52/106; 52/664; 49/61; 49/501

[58] Field of Search ..... 52/106, 314, 656.8, 52/664; 49/449, 501, 61, 62

[56] References Cited

U.S. PATENT DOCUMENTS

| | | | |
|---|---|---|---|
| 2,682,326 | 6/1954 | Fitzgerald | 52/669 |
| 3,340,661 | 9/1967 | Krieger | 52/507 X |
| 3,358,412 | 12/1967 | Martin | 52/507 X |
| 3,372,522 | 3/1968 | Engstrom | 52/507 X |
| 3,386,219 | 6/1968 | Beil | 52/507 X |
| 4,441,299 | 4/1984 | Gries | 52/106 X |
| 4,702,055 | 10/1987 | Ralph | 52/664 X |
| 4,723,388 | 2/1988 | Zieg | 52/656.8 |
| 5,392,570 | 2/1995 | Cowan | 52/106 |
| 5,813,187 | 9/1998 | Lee | 52/106 X |

FOREIGN PATENT DOCUMENTS

| | | | |
|---|---|---|---|
| 1113555 | 9/1961 | Germany | 52/106 |
| 2105596 | 8/1972 | Germany | 52/106 |

*Primary Examiner*—Richard E. Chilcot, Jr.
*Attorney, Agent, or Firm*—Rosenberg, Klein & Lee

[57] ABSTRACT

A grille includes a rectangular metal open frame formed of two main horizontal metal tubes and two main vertical metal tubes, a plurality of transverse metal tubes connected between the main vertical metal tubes, and a plurality of longitudinal metal tubes arranged into parallel rows in parallel to the main vertical metal tubes between the main horizontal metal tubes, wherein the main horizontal metal tubes each have a plurality of longitudinally spaced through holes, the transverse metal tubes each have a plurality of through holes corresponding to the through holes on the main horizontal metal tubes, and a plurality of screw bolts are respectively inserted through the through holes on the main horizontal metal tubes, the longitudinal metal tubes and the through holes on the transverse metal tubes are respectively screwed up with a respective lock nut to fix the main horizontal metal tubes, the transverse metal tubes and the longitudinal metal tubes together, enabling the main vertical metal tubes to be retained between the main horizontal metal tubes, and the longitudinal metal tubes of same row to be abutted against one another end to end in the through holes on the transverse metal tubes.

3 Claims, 6 Drawing Sheets

GRILLE FOR A DOOR OR WINDOW

BACKGROUND OF THE INVENTION

The present invention relates to a grille for a door or window, and more particularly to such a grille which can easily be assembled without welding.

A regular grille for a door or window is generally made by welding two main horizontal metal tubes 6 and two main vertical metal tubes 7 into a rectangular open frame, and then welding the rectangular open frame with transverse metal tubes 8 and longitudinal metal tubes 7 into a latticed structure. Because the grille is made by welding metal tubes into a latticed structure, much labor and work time are consumed, and the manufacturing cost of the grille is high. Furthermore, the welding point between each two linked metal tubes obstruct the sense of beauty of the grille.

SUMMARY OF THE INVENTION

The present invention has been accomplished to provide a grille which eliminates the aforesaid drawbacks. It is one object of the present invention to provide a grille which can easily be assembled without welding. It is another object of the present invention to provide a grille which is inexpensive to manufacture. It is still another object of the present invention to provide a grille which causes a sense of beauty. A grille according to the present invention is comprised of a rectangular metal open frame formed of two main horizontal metal tubes and two main vertical metal tubes, a plurality of transverse metal tubes connected between the main vertical metal tubes, a plurality of longitudinal metal tubes arranged into parallel rows in parallel to the main vertical metal tubes between the main horizontal metal tubes, and a plurality of screw bolts respectively inserted through respective through holes on the main horizontal metal tubes, the longitudinal metal tubes and respective through holes on the transverse metal tubes are respectively screwed up with a respective lock nut to fix the main horizontal metal tubes, the transverse metal tubes and the longitudinal metal tubes together, enabling the main vertical metal tubes to be retained between the main horizontal metal tubes, and the longitudinal metal tubes of same row to be abutted against one another end to end in the through holes on the transverse metal tubes. According to a second embodiment of the present invention, the longitudinal metal tubes are respectively stopped outside the transverse metal tubes or the main horizontal metal tubes, each having pairs of coupling flanges at the ends respectively engaged into respective coupling slots at the transverse metal tubes and the main horizontal metal tubes.

DETAILED DESCRIPTION OF THE PREFERRED EMBODIMENT

Figure 1:
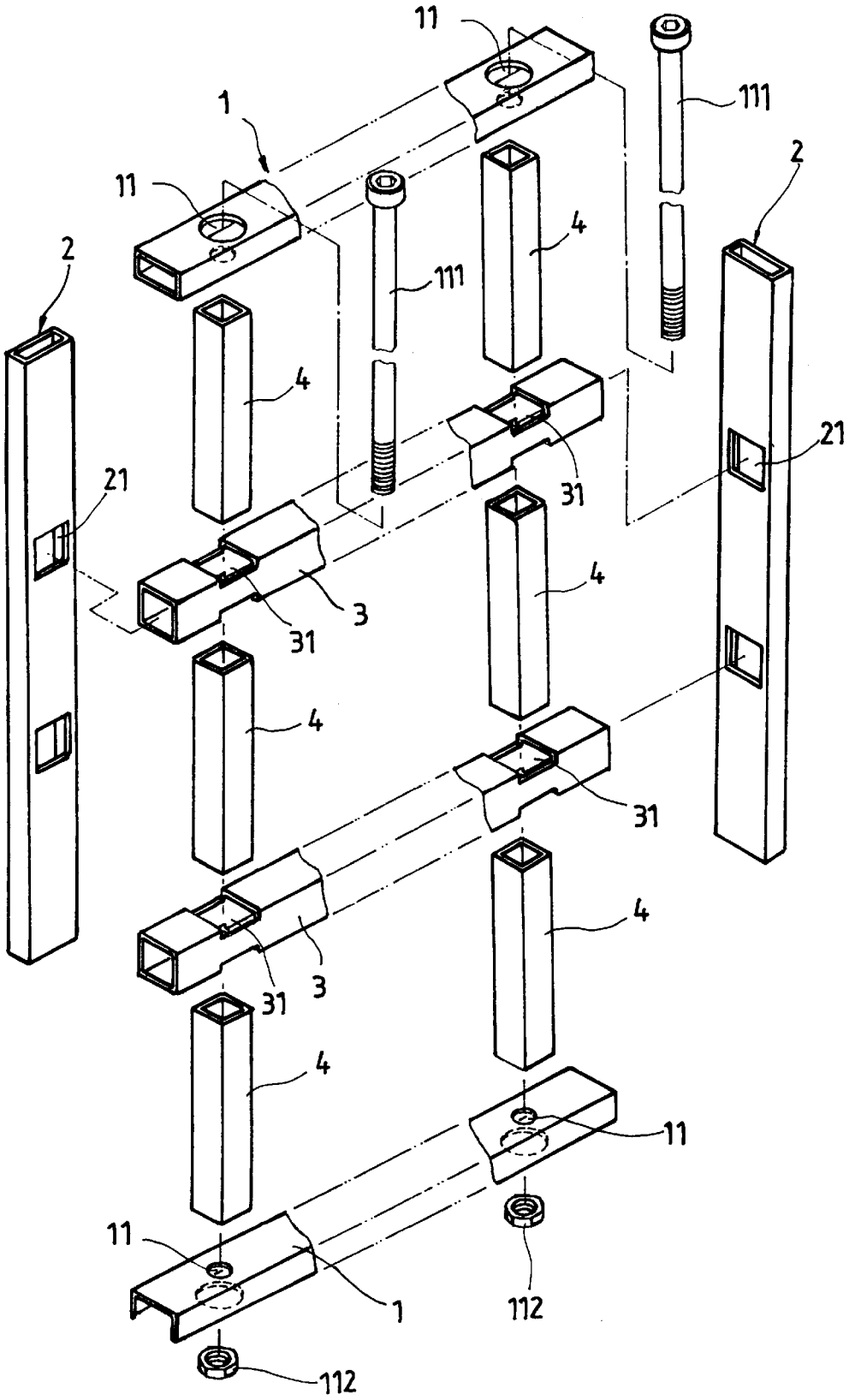
FIG. 1 is an exploded view of a grille according to a first embodiment of the present invention.
Figure 2:
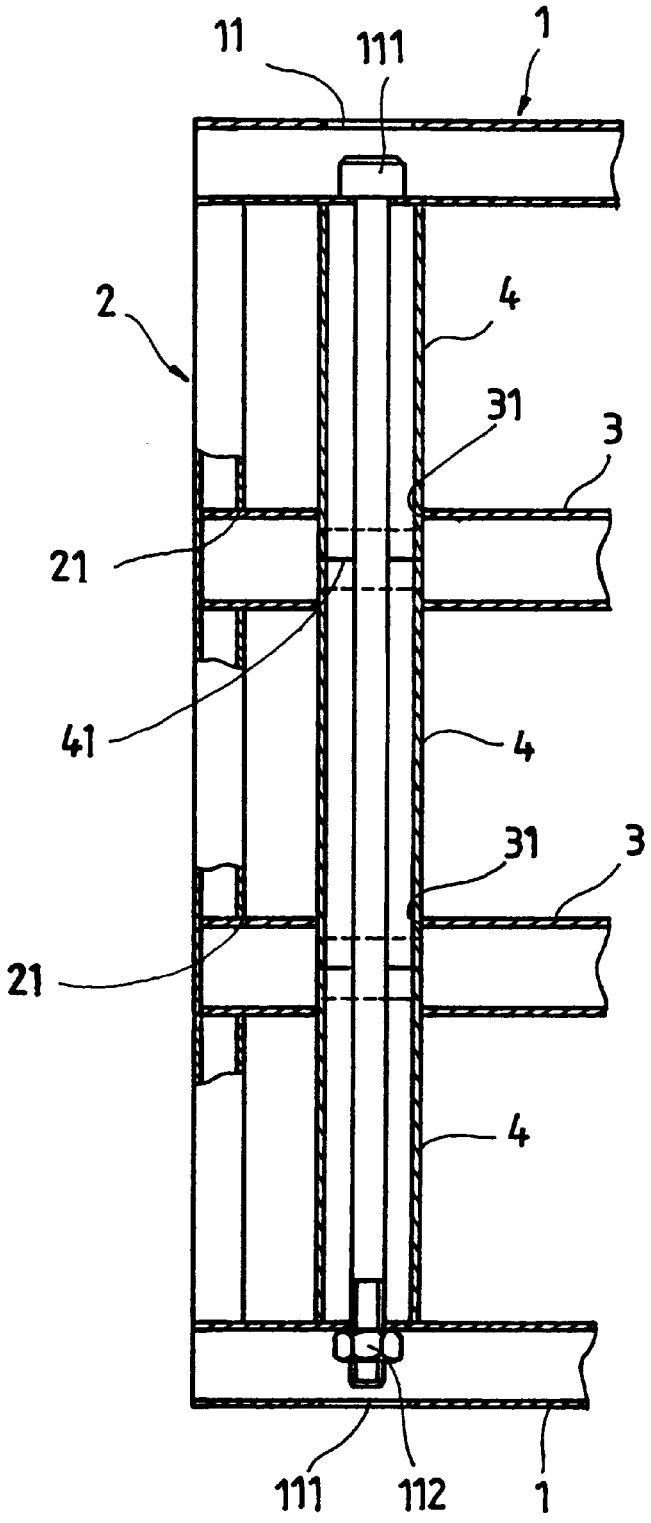
FIG. 2 is a sectional assembly view of a part of the grille shown in FIG. 1.
Figure 3:
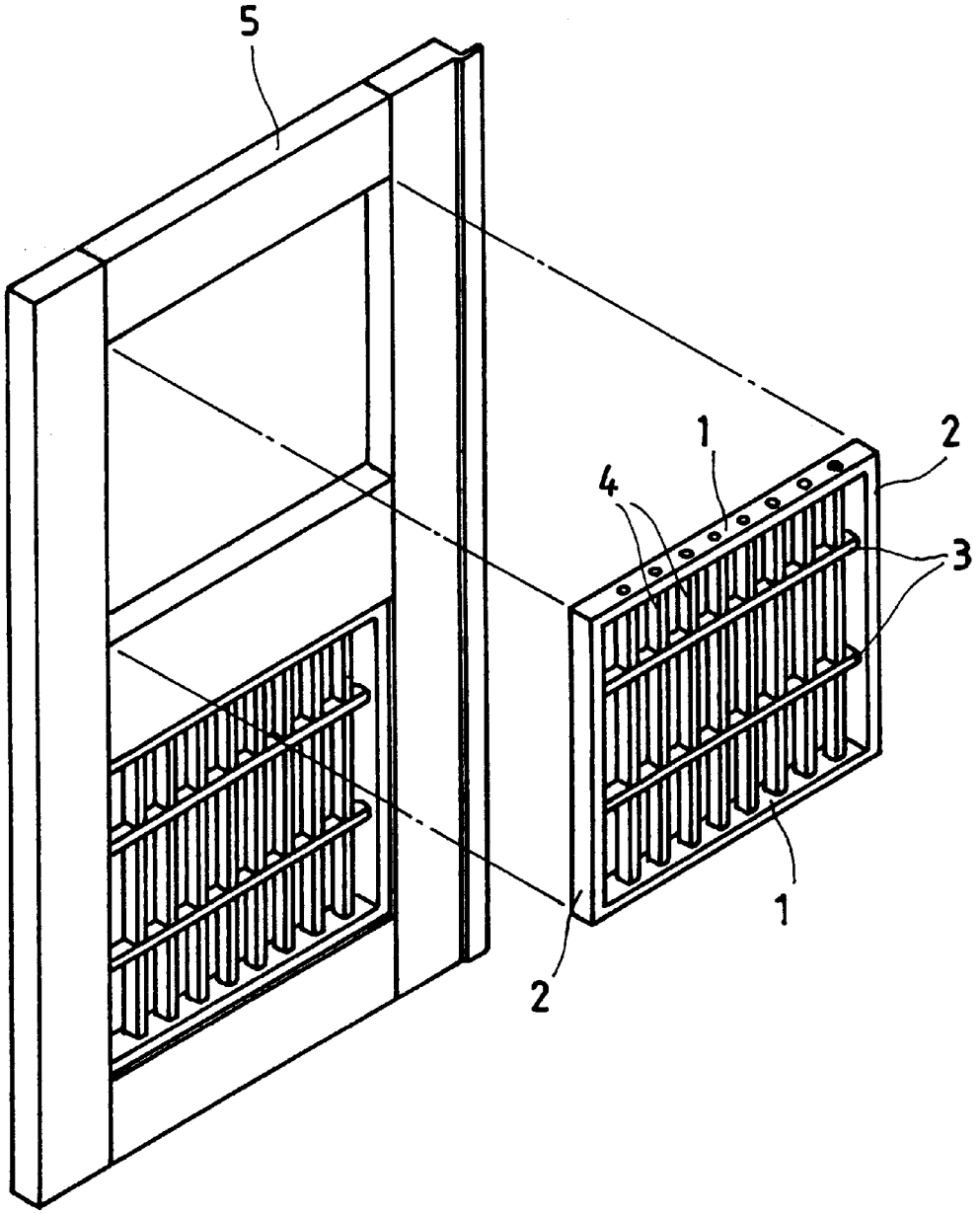
FIG. 3 is an applied view of the present invention, showing the positioning of the grille in an opening on a door.

Referring to FIGS. 1, 2 and 3, a grille according to a first embodiment of the present invention is provided for mounting in an opening on a window or door 5, comprised of a rectangular metal open frame formed of two main horizontal metal tubes, 1 and two main vertical metal tubes 2, a plurality of transverse metal tubes 3 connected between the main vertical metal tubes 2, and a plurality of longitudinal metal tubes 4 arranged into parallel rows in parallel to the main vertical metal tubes 2 between the main horizontal metal tubes 1. The longitudinal metal tubes 4 of the same row are respectively separated from one another by the transverse metal tubes 3. The main vertical metal tubes 2 each having a plurality of longitudinally spaced coupling holes 21 at an inner side. By engaging the ends of the transverse metal tubes 3 into the coupling holes 21 on the main vertical metal tubes 2, the main vertical metal tubes 2 are joined together by the transverse metal tubes 3. The main horizontal metal tubes 1 each have a plurality of through holes 11. The transverse metal tubes 3 each have a plurality of through holes 31 corresponding to the through holes 11 on the main horizontal metal tubes 1. A plurality of screw bolts 111 are respectively inserted through the through holes 11 on the main horizontal metal tubes 1, the through holes 31 on the transverse metal tubes 3 and the longitudinal metal tubes 4, and then respectively screwed up with a respective lock nut 112 to fix the main horizontal metal tubes 1, the transverse metal tubes 3 and the longitudinal metal tubes 4 together, enabling the main vertical metal tubes 2 to be retained between the main horizontal metal tubes 1. When assembled, the longitudinal metal tubes 4 of the same row are abutted against one another end to end in the through holes 31 on the transverse metal tubes 3.

Figure 4:
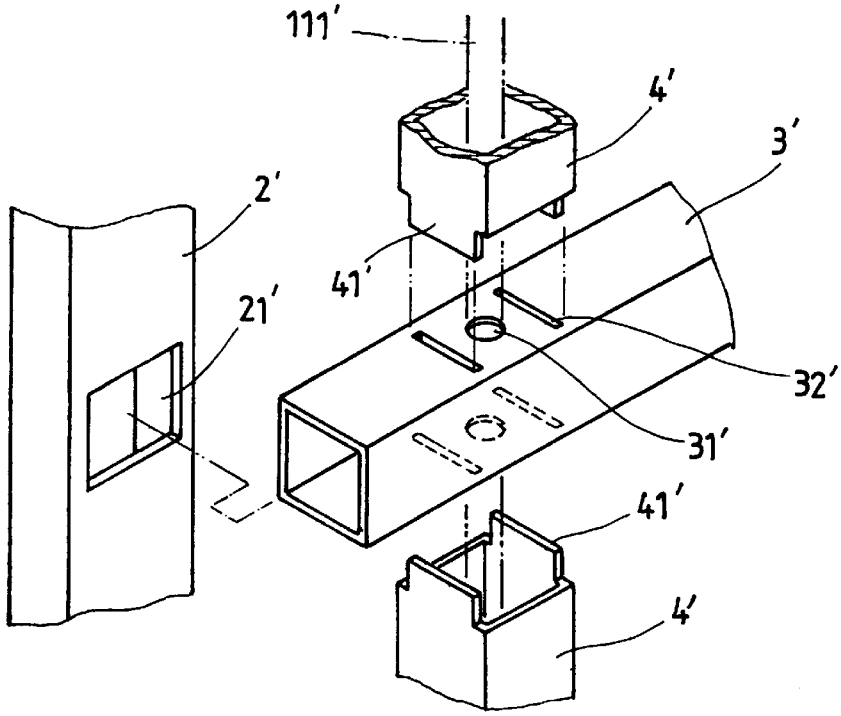
FIG. 4 is an exploded view of a part of a grille according to a second embodiment of the present invention.
Figure 5:
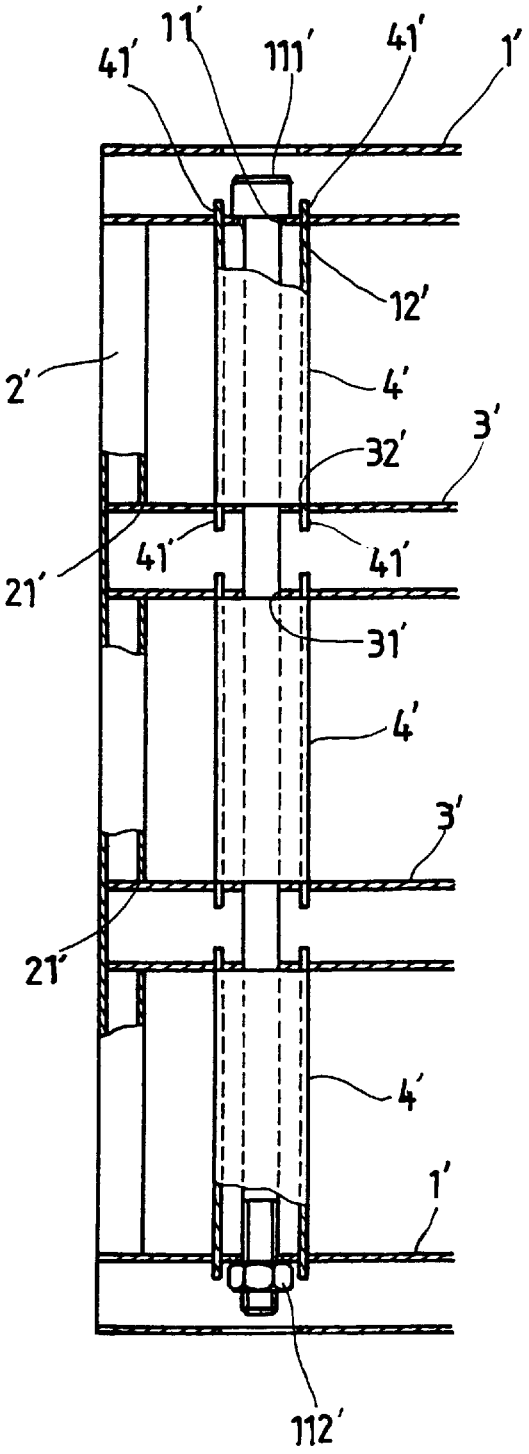
FIG. 5 is a sectional assembly view of the grille according to the second embodiment of the present invention.

FIGS. 4 and 5 show a metal grille according to a second embodiment of the present invention. According to this embodiment, the metal grille is comprised of a rectangular metal open frame formed of two main horizontal metal tubes 1' and two main vertical metal tubes 2', a plurality of transverse metal tubes 3' connected between the main vertical metal tubes 2', a plurality of longitudinal metal tubes 4' arranged into parallel rows in parallel to the main vertical metal tubes 2' between the main horizontal metal tubes 1', the longitudinal metal tubes 4' of the same row being respectively separated from one another by the transverse metal tubes 3', a plurality of screw bolts 111' respectively mounted in respective through holes 11' on the main horizontal metal tubes 1' and respective through holes 31' on the transverse metal tubes 3', and screwed up with respective lock nuts 112' to fix the main horizontal metal tubes 1', the transverse metal tubes 3' and the longitudinal metal tubes 4' together, enabling the main vertical metal tubes 2' to be retained between the main horizontal metal tubes 1' and the ends of the transverse metal tubes 3' to be retained engaged into respective coupling holes 21' on the main vertical metal tubes 2'. The diameter of the through holes 31' on the transverse metal tubes 3' is approximately equal to the diameter of the screw bolts 111'. Further, each transverse metal tube 3' has two parallel coupling slots 32' transversely arranged at two opposite sides of each through hole 31' through the top and bottom side walls. The main horizontal metal tubes 1' each have two parallel coupling slots 12' transversely arranged at two opposite sides of each through hole 11' on the bottom or top side wall corresponding to the coupling slots 32' on the transverse metal tubes 3'. The longitudinal metal tubes 4' each have a pair of coupling flanges 41' at each end respectively engaged into the coupling slots 32' on the transverse metal tubes 3' and the coupling slots 12' on the main horizontal metal tubes 1'.

Figure 6:
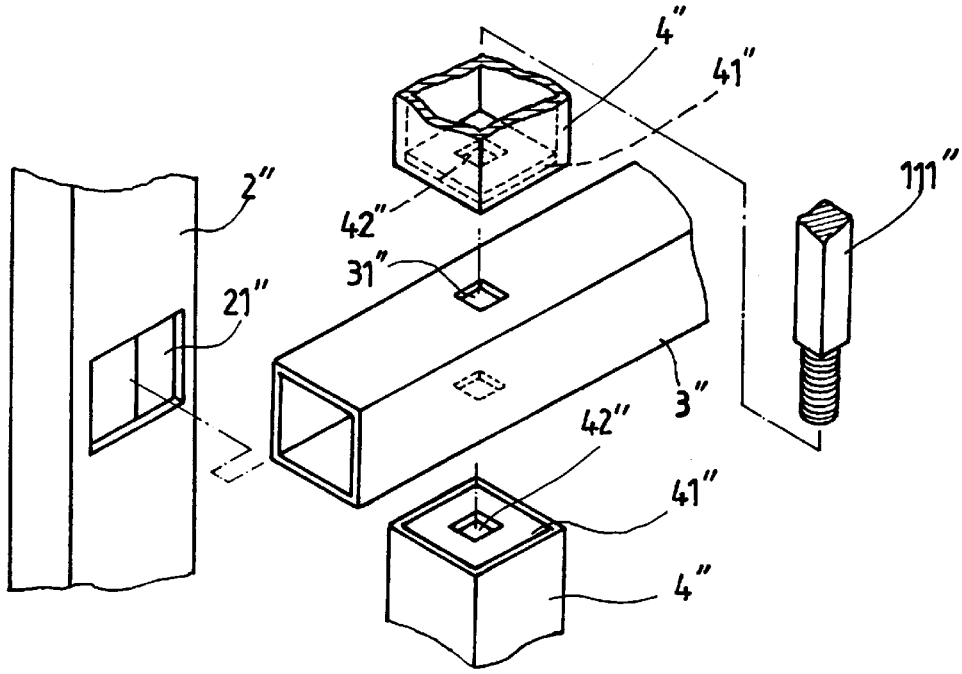
FIG. 6 is an exploded view of a part of a grille according to a third embodiment of the present invention.
Figure 7:
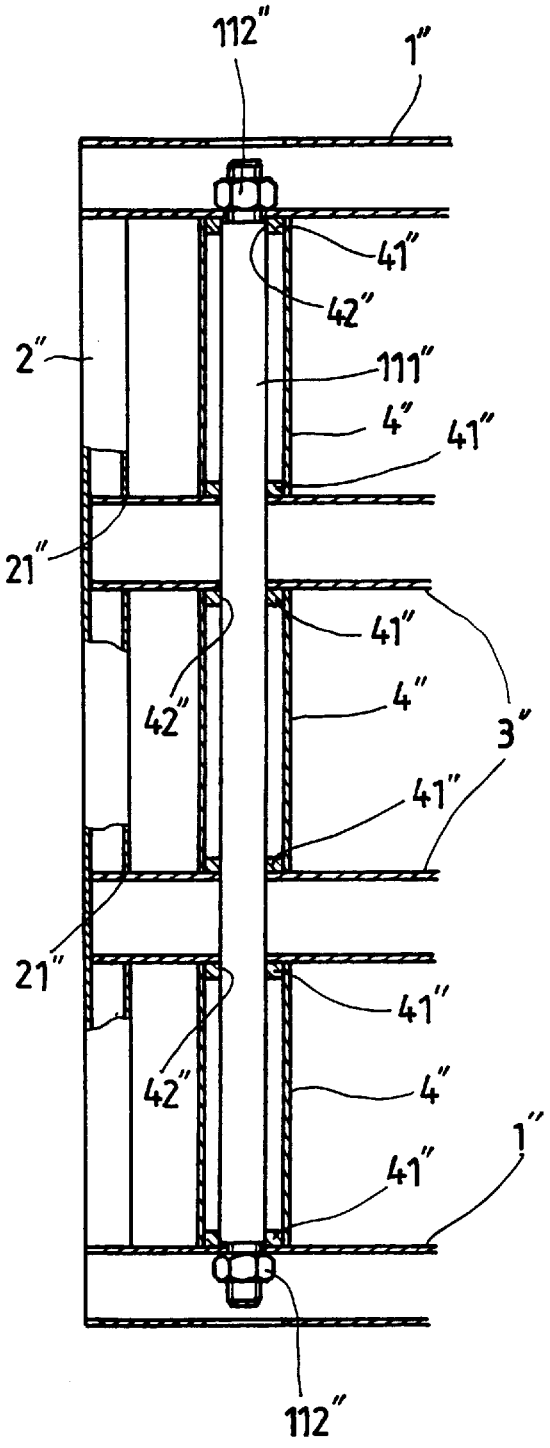
FIG. 7 is a sectional assembly view of the grille according to the third embodiment of the present invention.
Figure 8:
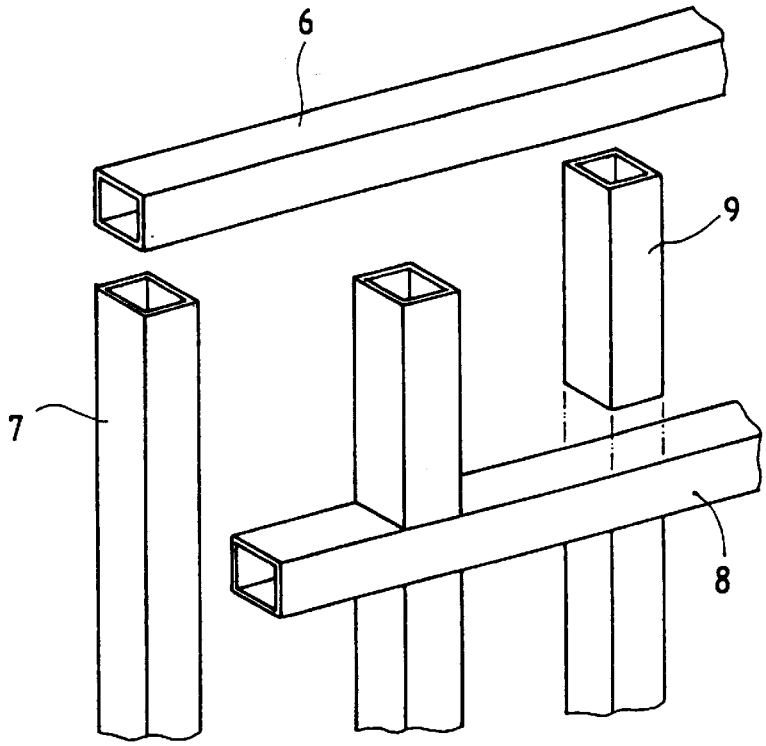
FIG. 8 PRIOR ART
Figure 9:
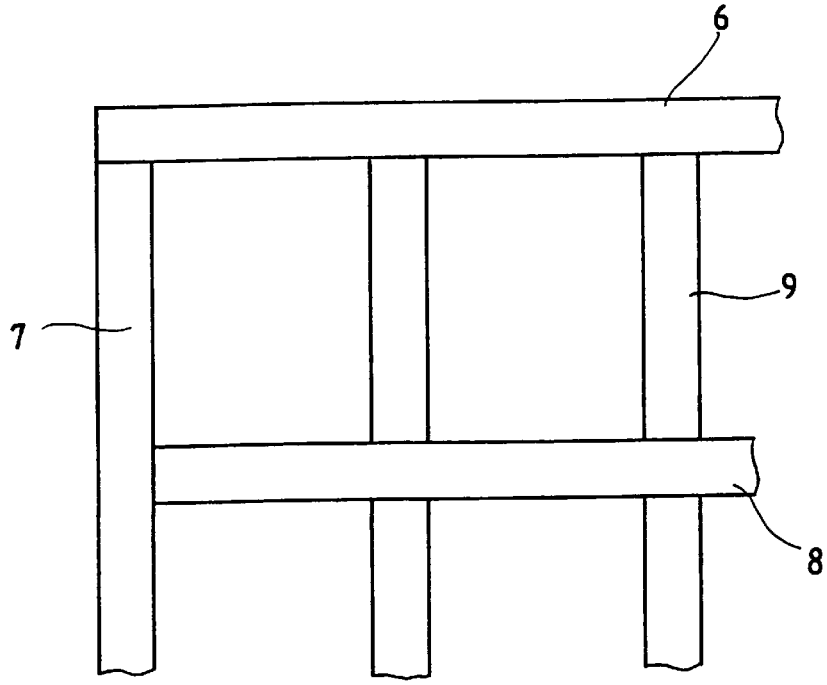
FIG. 9 PRIOR ART

FIGS. 6 and 7 show a metal grille according to a third embodiment of the present invention. According to this embodiment, the metal grille is comprised of a rectangular metal open frame formed of two main horizontal metal tube 1" and two main vertical metal tubes 2", a plurality of transverse metal tubes 3" connected between the main vertical metal tubes 2", a plurality of longitudinal metal tubes 4" arranged into parallel rows in parallel to the main vertical metal tubes 2" between the main horizontal metal tubes 1", the longitudinal metal tubes 4" of the same row being respectively separated from one another by the transverse metal tubes 3", a plurality of screw rods 111" respectively mounted in respective rectangular through holes 11" on the main horizontal metal tubes 1" and respective rectangular through holes 31" on the transverse metal tubes 3", and screwed up with respective lock nuts 112" to fix the main horizontal metal tubes 1", the transverse metal tubes 3" and the longitudinal metal tubes 4" together, enabling the main vertical metal tubes 2" to be retained between the main horizontal metal tubes 1" and the ends of the transverse metal tubes 3" to be retained engaged into respective coupling holes 21" on the main vertical metal tubes 2". The longitudinal metal tubes 4" each have two opposite ends closed by a respective end wall 41", and the end wall 41" at each end of each longitudinal metal tube 4" has a rectangular through hole 42". The screw rods 111" each have a rectangular rod body, that fits the rectangular through holes 42" on the end walls 41" of the longitudinal metal tubes 4", the rectangular through holes 31" on the transverse metal tubes 3" and the rectangular through holes 11" on the main horizontal metal tubes 1", and two threaded end pieces respectively screwed up with the respective lock nuts 112".

It is to be understood that the drawings are designed for purposes of illustration only, and are not intended as a definition of the limits and scope of the invention disclosed.

What the invention claimed is:

1. A grille comprising a rectangular metal open frame formed of two main horizontal metal tubes respectively disposed at top and bottom sides and two main vertical metal tubes respectively disposed at left and right sides, a plurality of transverse metal tubes connected between said main vertical metal tubes, and a plurality of longitudinal metal tubes arranged into parallel rows in parallel to said main vertical metal tubes between said main horizontal metal tubes, the longitudinal metal tubes of same row being respectively separated from one another by said transverse metal tubes, wherein said main horizontal metal tubes each have a plurality of longitudinally spaced through holes; said transverse metal tubes each have a plurality of through holes corresponding to the through holes on said main horizontal metal tubes and pairs of transversely extended coupling slots arranged in parallel at two opposite sides of each through hole on said transverse metal tubes; said longitudinal metal tubes each have a pair of coupling flanges disposed at each end and respectively engaged into the coupling slots on said transverse metal tubes, and a plurality of screw bolts are respectively inserted through the through holes on said main horizontal metal tubes, said longitudinal metal tubes and the through holes on said transverse metal tubes and respectively screwed up with a respective lock nut to fix said main horizontal metal tubes, said transverse metal tubes and said longitudinal metal tubes together, enabling said main vertical metal tubes to be retained between said main horizontal metal tubes.

2. The grille of claim 1 wherein said transverse metal tubes and said longitudinal metal tubes are round tubes.

3. The grille of claim 1 wherein said transverse metal tubes and said longitudinal metal tubes are rectangular tubes.

* * * * *